US006338332B1

(12) United States Patent
Kluhsman

(10) Patent No.: US 6,338,332 B1
(45) Date of Patent: Jan. 15, 2002

(54) QUICK ATTACH LINKAGE

(75) Inventor: Melvin L. Kluhsman, Lockwood, MO (US)

(73) Assignee: Kluhsman Machine, Inc., Lockwood, MO (US)

( * ) Notice: Subject to any disclaimer, the term of this patent is extended or adjusted under 35 U.S.C. 154(b) by 0 days.

(21) Appl. No.: 09/604,191

(22) Filed: Jun. 27, 2000

(51) Int. Cl.[7] ..... F02D 11/04
(52) U.S. Cl. ..... 123/400
(58) Field of Search ..... 123/336, 337, 123/400, 583, 584; 261/65; 403/122; 74/482, 513

(56) References Cited

U.S. PATENT DOCUMENTS 2,859,060 A * 11/1958 Davies et al. ..... 403/122
3,580,100 A * 5/1971 McDermott ..... 74/482
4,411,845 A * 10/1983 Tanahashi et al. ..... 123/400 X
4,520,546 A * 6/1985 Darnell ..... 403/122 X
5,228,737 A * 7/1993 Zimmerman ..... 296/76
5,921,225 A * 7/1999 Nakamura ..... 123/583

OTHER PUBLICATIONS

Tuthill Linkage Group, Catalog p. 63, Quick Disconnect (Type S) Ball Joint.*

* cited by examiner

*Primary Examiner*—Tony M. Argenbright
(74) *Attorney, Agent, or Firm*—Hovey Williams Timmons & Collins

(57) ABSTRACT

A quick attach-detach carburetor linkage (10) is provided to allow connection between an automobile throttle linkage (16) and a carburetor (14). The linkage (10) includes an elongated rod (18) with attachment assemblies (20, 22) at the forward and rearward ends thereof. The assembly (20) includes a shaft (28) having a reduced diameter extension (36) with a socket (38) formed therein, together with a throttle connector (12) including a ball screw (60) which is received within the socket (38). A tubular keeper (42) is supported on the extension (36) and has a generally U-shaped slot (46) formed therein and presenting differently sized ends (48, 50). A spring (54) engages the keeper (42). When the keeper is in its locking position, the smaller slot end (50) is disposed adjacent socket (30) and prevents separation of the ball screw (68) and socket (38).

6 Claims, 3 Drawing Sheets

QUICK ATTACH LINKAGE

BACKGROUND OF THE INVENTION

1. Field of the Invention

The present invention is broadly concerned with quick attach-detach linkages for various purposes, e.g., as carburetor linkages for use in race cars where it is often necessary to connect and disconnect carburetor linkage. More particularly, the invention pertains to such linkages which in preferred forms including mating connectors and couplers with a shiftable, spring-biased keeper which can be manually moved between respective positions for fast, easy attachment or detachment of the linkage.

2. Description of the Prior Art

During the course of automotive racing time trials and in some instances during actual races, it is necessary to detach the race car's carburetor linkage to allow inspection of the carburetor and the related manifold. For example, race officials may inspect a car for the presence of a "shaved manifold" or improperly sized restrictor plates. Conventional racing car carburetor linkages make use of so-called Heim ends which include swivel eyes. In order to disconnect such linkages, two small wrenches must be used. This involves a minimum of 3–5 minutes in time, which must be performed in the close confines of an engine compartment over a hot racing engine. Also, disassembly of a conventional linkage involves disassembly of small nuts, bolts and spacers, which can readily fall into the intake manifold and be difficult or even impossible to retrieve. Given that racing carburetors must be removed several times a day during trials and inspections, it will be appreciated that the attach-detach time and effort for carburetor linkages becomes a significant factor.

In other instances, throttle linkages are used to control the habits of race car drivers. For example, in a sticky clay or dirt track the full horsepower of the race car engine should be used. However, during the course of a race, the track may become "dry slick", so that the car tires will not fully grip the track surface, resulting in tire spin. In these instance, it is known to attach a longer throttle linkage so that the carburetor cannot be operated fill open by the driver. This reduces horsepower delivered to the wheels and can actually reduce lap times. Here again, in the context of an ongoing race, time is of the essence and therefore a quick attach-detach carburetor linkage would be a decided advantage.

Apart from carburetor linkages, other types of rod-operated mechanisms may be improved through use of a linkage assembly having a quick attach design.

There is accordingly a need in the art for a quick-detach carburetor which can be used in the context of race cars and which resists inadvertent disconnection through vibration or the like, while at the same time permitting a mechanic to attach or detach the linkage in a matter of seconds. Similarly, quick attach-detach linkages for other purposes would also be advantageous.

SUMMARY OF THE INVENTION

The present invention overcomes the problems outlined above, and provides a greatly improved quick attach-detach linkages. In one preferred embodiment, carburetor linkages are provided in the form of an elongated rod which extends between the normal throttle linkage of the automobile and the carburetor, together with an attachment assembly coupling the forward end of the rod and the carburetor; the attachment assembly includes a throttle connector and a mating coupler, and a spring-biased keeper which attaches the throttle connector and coupler in a first position of the keeper. The keeper is manually movable against the bias of the spring to a different position allowing the throttle connector and coupler to be manually separated.

In preferred forms, one of the throttle connector and coupler comprises a ball, while the other of the connector and coupler comprises a socket adapted to receive the ball. Normally, the rod includes an attachment body at the end thereof which has a socket formed therein. The throttle connector on the other hand includes a ball screw presenting a ball adapted to be received within the socket. The keeper is preferably a shiftable, tubular sleeve mounted on the attachment body and having an elongated, generally U-shaped slot formed therein presenting a pair of differently sized ends. One end of the slot is configured to engage the ball when the latter is received within the socket to prevent separation of the ball and socket. The other, larger end of the slot is configured to allow manual separation of the ball and socket. The keeper sleeve is thus shiftable for selective movement so that the slot ends may be alternately positioned adjacent the socket.

Preferably, an identical attachment assembly is also secured to the rearward end of the rod to allow quick attach-detach connection between the rod and the automobile throttle linkage.

DETAILED DESCRIPTION OF THE PREFERRED EMBODIMENT

Figures 1, 2:
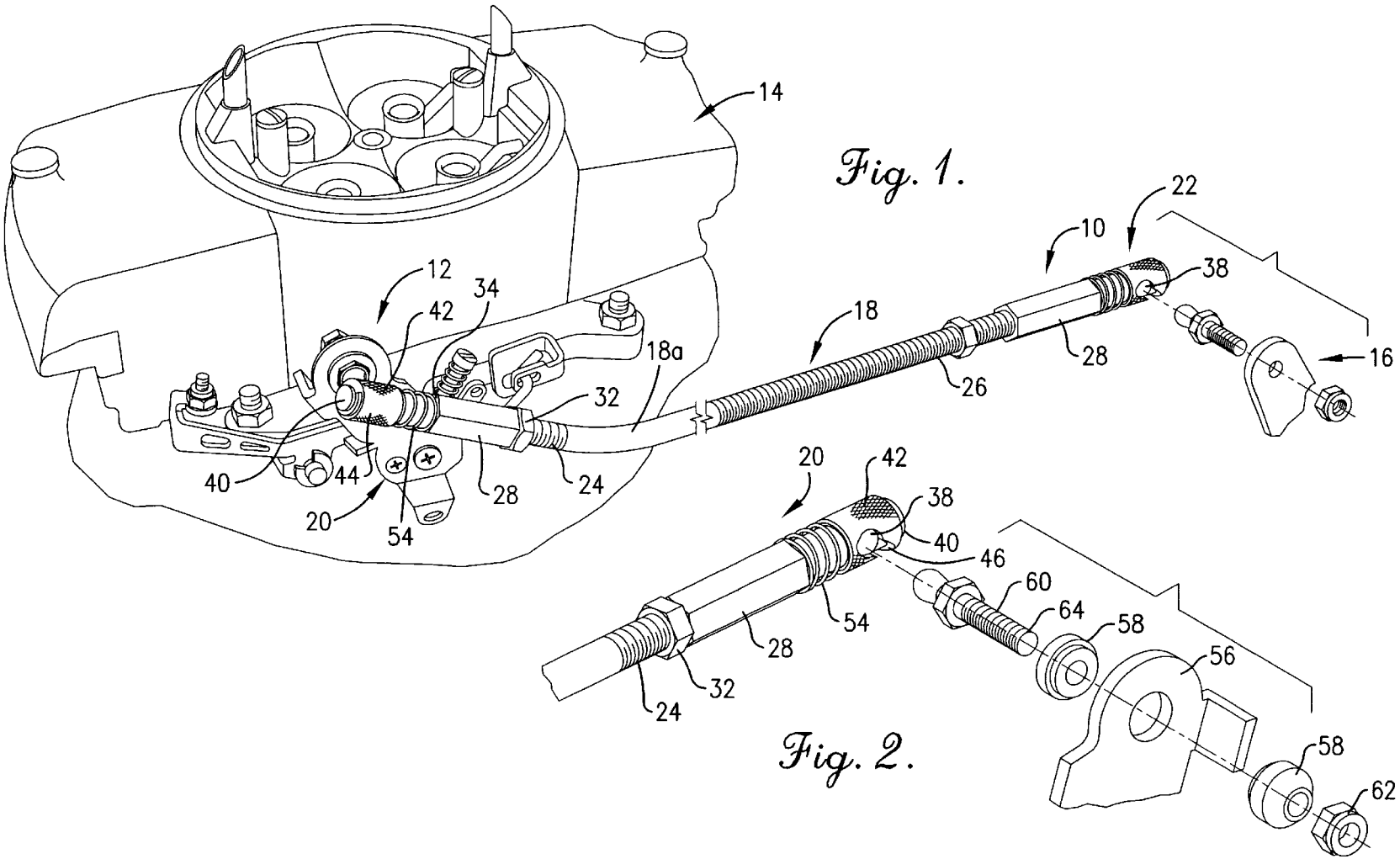
FIG. 1 is a fragmentary perspective view with parts shown in exploded relationship, illustrating an automobile carburetor with the carburetor linkage of the invention coupled between the carburetor throttle connector and the automobile throttle linkage.
FIG. 2 is a fragmentary exploded view depicting the interconnection of the carburetor linkage and the carburetor throttle connector.
Figure 3:
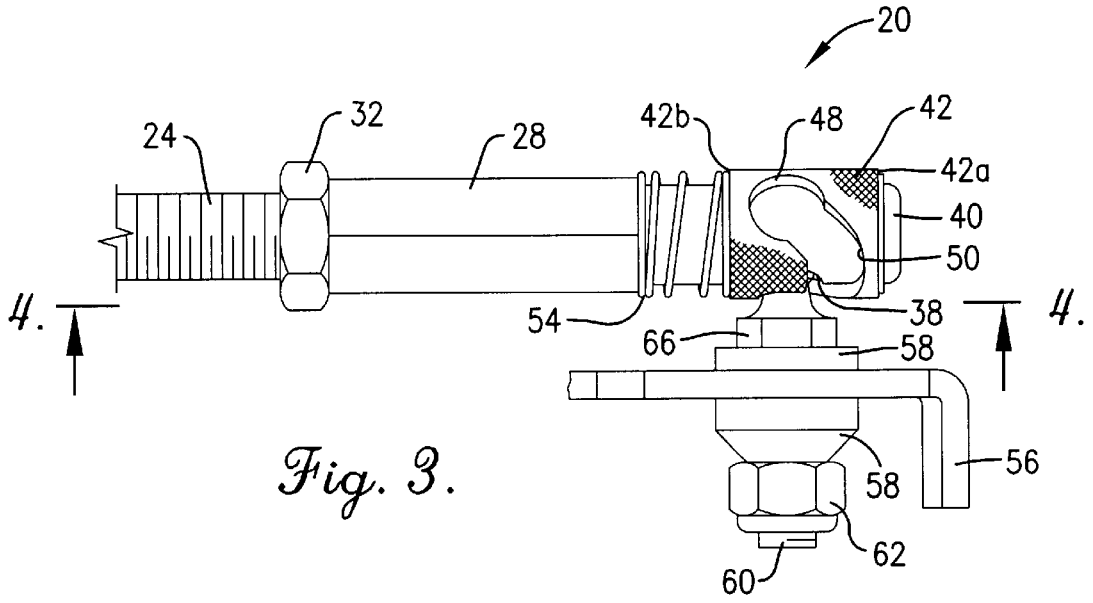
FIG. 3 is a fragmentary side view illustrating the carburetor linkage operably connected to the carburetor throttle connector.
Figure 4:
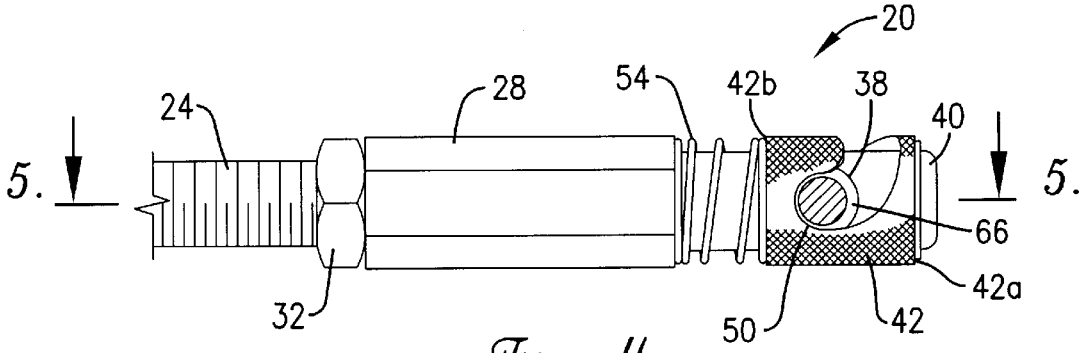
FIG. 4 is a sectional view taken along line 4—4 of FIG. 3.

Turning now to the drawings, and particularly FIG. 1, a carburetor linkage 10 in accordance with the invention is designed to releasably connect a throttle connector 12 attached to an otherwise conventional carburetor 14 to the throttle linkage 16 of an automobile. Broadly speaking, the linkage 10 includes an elongated rod 18 with respective, essentially identical attachment assemblies 20, 22 at the forward and rearward ends of the rod 18 respectively.

In more detail, the rod 18 is preferably formed of lightweight aluminum or similar material and includes threading 24 and 26 at the fore and aft ends thereof. In the embodiment shown, the rod 18 is essentially rectilinear throughout the majority of its length, but includes an upturned section 18*a* adjacent the forward end thereof. It will be appreciated that he specific configuration of rod 18 can be changed as necessary to accommodate any particular location of a given automobile's throttle linkage and carburetor throttle connector.

The attachment assembly 20 includes an elongated shaft 28 presenting a rearward, internally threaded bore 30 (FIG. 5) which is adapted to receive the threaded end 24 of rod 18. A locking nut 32 is also threaded onto the section 24 so as to properly position the shaft 28 in place. The shaft 28 is hexagonal in outer configuration throughout the majority of its length, but presents a forwardmost abutment shoulder 34 and an integral extension 36 of reduced diameter. The extension 36 has an inwardly extending socket 38 formed therein and supports a forwardmost abutment stop 40.

Figure 7:
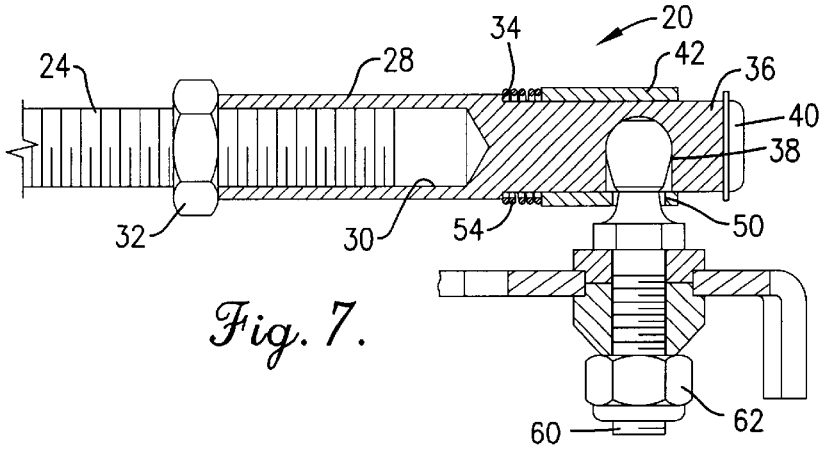
FIG. 7 is a sectional view taken along line 7—7 of FIG. 6.

In addition, a tubular keeper 42 having fore and aft ends 42*a*, 42*b* is shiftably mounted on the extension 36 and is movable between shoulder 34 and stop 40. The keeper 42 has a knurled outer surface as at 44, so as to facilitate manual manipulation of the keeper as will be explained. The keeper also includes a somewhat U-shaped slot 46 formed in the sidewall thereof. The slot 46 has first and second ends 48, 50 (FIG. 7) as well as a central bight section 52. The end 48 of slot 46 is sized to substantially register with the periphery of socket 38, i.e., when the end 48 is disposed about the socket 38, unimpeded access is provided to the socket. On the other hand, the slot end 50 is smaller than the periphery of the socket 38, which is important for purposes to be described. A coil spring 54 is disposed about the extension 36 and is located between shoulder 34 of shaft 28 and the trailing surface 42*b* of keeper 42. Thus, the spring 54 biases the keeper 42 against forwardmost stop 40.

The throttle connector 12 in the form shown includes a pivotal lug 56 with complemental bushings 58, a ball screw 60 and connecting nut 62. The ball screw 60 includes an elongated threaded shaft 64 designed to receive the nut 62, a hexagonal base 66 and an arcuate connecting ball 68. It will be appreciated that the ball screw 60 actually connects the carburetor to the rod 18, and that the remaining components of the overall throttle connector 12 are variable, depending upon the particular type of carburetor employed and the throttle connection hardware associated with the carburetor.

Figure 5:
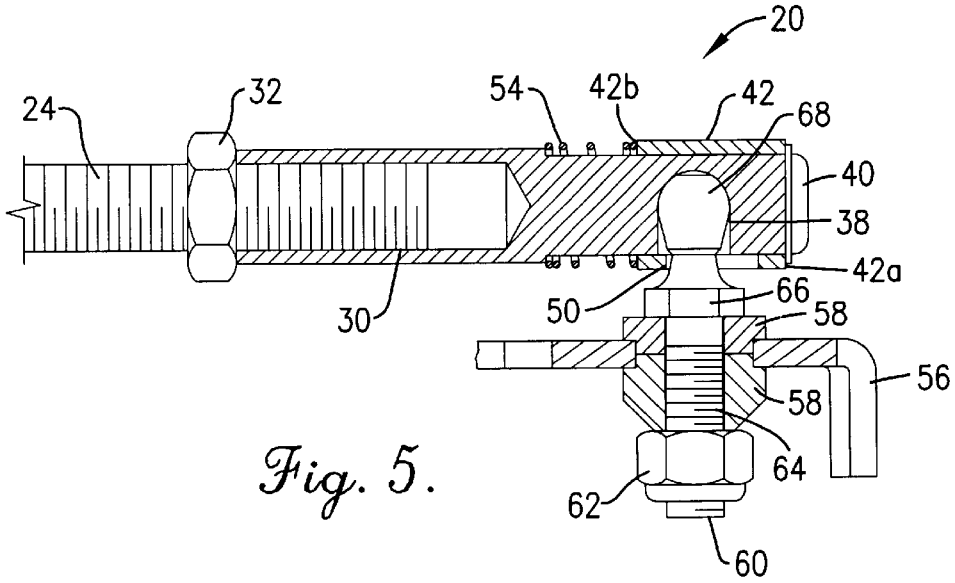
FIG. 5 is a sectional view taken along line 5—5 of FIG. 4.

The normal operation of linkage 10, i.e., when the rod 18 is coupled with the throttle connector 12, is shown in FIGS. 1 and 3–5. In this orientation, the ball 68 is seated within socket 38 and the keeper 42 is positioned with smaller end 50 disposed adjacent the socket opening. As best seen in FIG. 5, this smaller opening prevents separation of the ball 68 from the socket 38, so that the throttle linkage 16 is moved in response to shifting of the rod 18.

Figure 6:
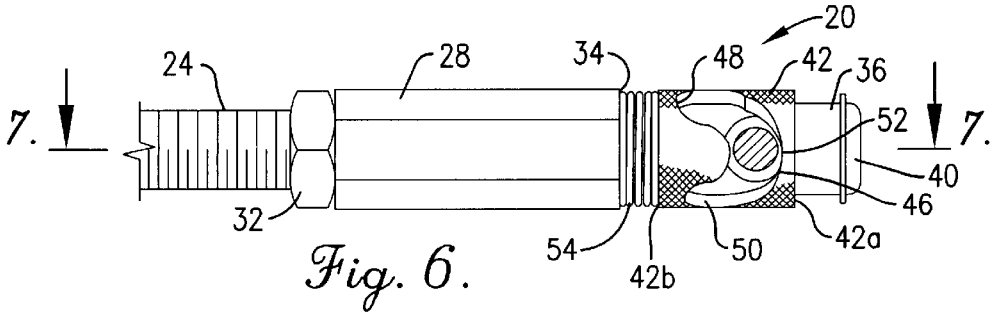
FIG. 6 is a sectional view similar to that of FIG. 4, but illustrating the configuration of the carburetor linkage during the course of shifting of the keeper thereof between the locked and unlocked positions.
Figure 8:
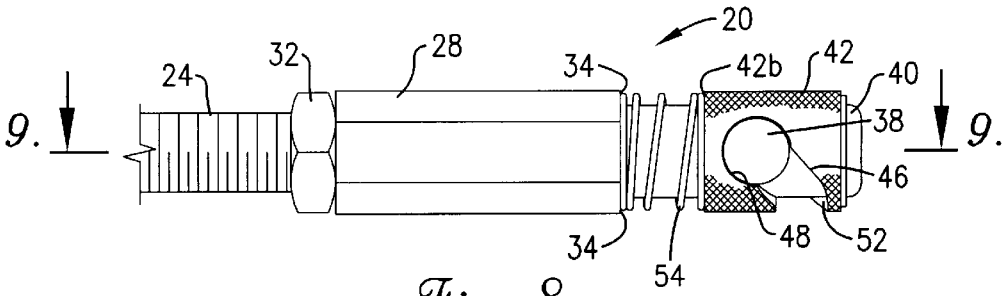
FIG. 8 is a fragmentary side view illustrating the linkage with the carburetor throttle connector removed.
Figure 9:
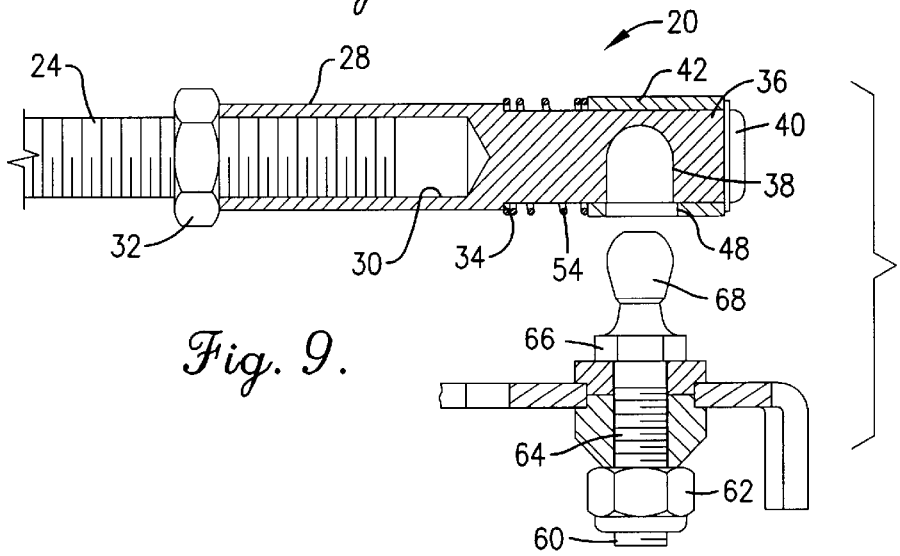
FIG. 9 is a vertical sectional view taken along line 9—9 of FIG. 8 and illustrating separation of the carburetor linkage from the carburetor throttle connector.

If it is necessary to disconnect the linkage 10 from the throttle connector, it is only necessary to manually grasp the keeper 42 and rotate it through the length of slot 46 until the larger end 48 of the slot comes into adjacency and substantial registry with the periphery of socket 38 as shown in FIG. 8. An intermediate position of the keeper 42 midway between the ends 48, 50 is depicted in FIG. 6. Once the keeper is in the FIG. 8 position, the ball 68 can be readily pulled from the socket 38, thereby fully disconnecting the rod 18 from the linkage 10 from throttle connector 12. Of course, reattachment of the linkage 10 to the carburetor involves reversal of this process.

As indicated above, the rearward attachment assembly 22 is virtually identical with assembly 20. Accordingly, like components have been numbered identically in the assemblies 20 and 22. Furthermore, the attach-detach operation of the assembly 22 is the same as that for assembly 20.

Although the preferred embodiment has been described in the context of a carburetor linkage, it will be understood that the invention is not so limited. Rather, the invention pertains to linkage assemblies which may be coupled with a variety of rod-operated mechanisms.

I claim:

1. The combination comprising:

a carburetor having a throttle connector;

a throttle linkage spaced from said carburetor;

an elongated rod presenting fore and aft ends respectively adjacent said throttle connector and said throttle linkage;

fore and aft attachment assemblies adjacent corresponding ends of said rod and operably interconnecting said rod to said throttle connector and said throttle linkage, at least one of said attachment assemblies being a quick attach-detach assembly and having a ball;

a socket receiving said ball;

a keeper manually shiftable between a first position attaching the ball and socket, and a second position allowing manual separation of the ball and socket; and a spring operably engaging said keeper to said first position when the keeper is moved to the first position, said keeper manually movable against the bias of said spring to said second position to permit said manual separation of the ball and socket.

2. The combination of claim 1, said fore and aft attachment assemblies being threadably secured to said corresponding ends of said rod.

3. The combination of claim 1, said keeper comprising a shiftable tubular sleeve having a generally U-shaped slot formed in the sidewall thereof, said slot presenting first and second ends, said first slot end sized to permit insertion and removal of said ball from and into said slot, said second end sized to prevent removal of said ball from said socket when the ball is seated within the socket.

4. The combination of claim 1, said fore and aft attachment assemblies both being quick attach-detach assemblies and each having a ball;

a socket receiving said ball;

a keeper manually shiftable between a first position attaching the ball and socket, and a second position allowing manual separation of the ball and socket; and a spring operably engaging said keeper to said first position when the keeper is moved to the first position, said keeper manually movable against the bias of said spring to said second position to permit said manual separation of the ball and socket.

5. The combination of claim 1, said keeper with a knurled outer surface.

6. The combination of claim 1, said attachment assemblies including a stop engaging the margin of said keeper remote from said spring so as to captively retain the keeper on said attachment assemblies.

* * * * *